US009227123B2

(12) United States Patent
DeBolt et al.

(10) Patent No.: US 9,227,123 B2
(45) Date of Patent: Jan. 5, 2016

(54) LACROSSE TRAINING DEVICE

(71) Applicants: Patrick DeBolt, Dallas, TX (US); Robert DeBolt, Waterloo, NY (US)

(72) Inventors: Patrick DeBolt, Dallas, TX (US); Robert DeBolt, Waterloo, NY (US)

( * ) Notice: Subject to any disclaimer, the term of this patent is extended or adjusted under 35 U.S.C. 154(b) by 230 days.

(21) Appl. No.: 13/665,525

(22) Filed: Oct. 31, 2012

(65) Prior Publication Data

US 2013/0303312 A1 Nov. 14, 2013

Related U.S. Application Data

(60) Provisional application No. 61/553,601, filed on Oct. 31, 2011.

(51) Int. Cl.

| | |
|---|---|
| ***A63B 69/00*** | (2006.01) |
| *A63B 63/00* | (2006.01) |
| *A63B 71/02* | (2006.01) |
| *A63B 24/00* | (2006.01) |

(52) U.S. Cl.

CPC ..... *A63B 69/00* (2013.01); *A63B 69/0097* (2013.01); *A63B 24/00* (2013.01); *A63B 63/004* (2013.01); *A63B 71/021* (2013.01); *A63B 2071/025* (2013.01); *A63B 2209/10* (2013.01); *A63B 2210/50* (2013.01); *A63B 2225/09* (2013.01); *A63B 2225/50* (2013.01); *A63B 2243/005* (2013.01)

(58) Field of Classification Search

CPC ..... A63B 69/00
USPC ..... 473/446, 513; 273/359; D21/701
See application file for complete search history.

(56) References Cited

U.S. PATENT DOCUMENTS

| | | | | | |
|---|---|---|---|---|---|
| 357,867 | A | * | 2/1887 | Mehrens | 249/58 |
| 645,229 | A | * | 3/1900 | Moller | 273/367 |
| 1,061,577 | A | * | 5/1913 | Whitney | 273/367 |
| 3,573,867 | A | * | 4/1971 | Mehrens | 473/439 |
| 4,489,940 | A | * | 12/1984 | Amundson | 473/446 |
| 4,960,284 | A | | 10/1990 | Stude | |
| 5,509,650 | A | | 4/1996 | Madonald | |
| 5,772,537 | A | * | 6/1998 | Anderson et al. | 473/435 |
| 5,857,679 | A | | 1/1999 | Ringe | |
| 5,938,546 | A | | 8/1999 | Caruso | |
| 6,196,938 | B1 | * | 3/2001 | Wiedner | 473/476 |
| 6,402,641 | B1 | * | 6/2002 | Lee | 473/446 |
| 6,595,878 | B1 | | 7/2003 | Nelson | |
| 6,736,739 | B1 | * | 5/2004 | Epworth | 473/443 |
| 6,796,914 | B2 | * | 9/2004 | Berdugo et al. | 473/439 |
| 6,899,645 | B1 | * | 5/2005 | Hsiao | 473/446 |
| 6,935,971 | B2 | | 8/2005 | Piras | |
| 7,037,219 | B2 | | 5/2006 | Pakieser | |
| 7,074,140 | B1 | | 7/2006 | Mcnary | |
| 7,264,245 | B2 | | 9/2007 | Cho | |
| 7,293,776 | B2 | | 11/2007 | Fenwick | |
| 7,462,114 | B2 | | 12/2008 | Moller, Jr. | |
| 7,578,757 | B1 | | 8/2009 | Mcnary | |
| 7,651,416 | B2 | | 1/2010 | Farquhar | |

(Continued)

*Primary Examiner* — Gene Kim
*Assistant Examiner* — M Chambers
(74) *Attorney, Agent, or Firm* — Standley Law Group LLP

(57) ABSTRACT

A lacrosse training device that has a frame and target material therein. The flexibility of the target material may be adjustable. The device is adapted to be suspended within a lacrosse goal. The device may have means for adjusting the tension of the target material. The target material may slip on over the frame like a sleeve. The device may have wheels, which may be located on a track. The device may have a motor that moves it to different sides of a goal. The device may move in response to a wireless controller.

18 Claims, 15 Drawing Sheets

(56) References Cited

U.S. PATENT DOCUMENTS

| | | | | |
|---|---|---|---|---|
| 7,661,679 | B2 | 2/2010 | Mah | |
| 7,811,184 | B2 | 10/2010 | Siefker | |
| 7,850,514 | B2 | 12/2010 | Weber | |
| 2007/0265115 | A1 | 11/2007 | Farquhar | |
| 2008/0076606 | A1 | 3/2008 | Siefker | |
| 2009/0181810 | A1 | 7/2009 | Stephenson | |
| 2010/0069178 | A1 | 3/2010 | Plut | |
| 2010/0125009 | A1 | 5/2010 | Goldwitz | |
| 2010/0222162 | A1* | 9/2010 | Stephenson | 473/446 |
| 2011/0015002 | A1 | 1/2011 | Brown | |
| 2011/0053713 | A1 | 3/2011 | Bulloch | |
| 2012/0100940 | A1* | 4/2012 | Hajarian | 473/476 |
| 2013/0303312 | A1* | 11/2013 | DeBolt et al. | 473/446 |

* cited by examiner

LACROSSE TRAINING DEVICE

CROSS-REFERENCE TO RELATED APPLICATIONS

This application claims the benefit of priority from U.S. Provisional Patent Application No. 61/553,601, filed Oct. 31, 2011, which is hereby incorporated by reference in its entirety.

TECHNICAL FIELD

Exemplary embodiments of the inventive concept relate to a lacrosse training device. More particularly, exemplary embodiments of the inventive concept relate to a lacrosse training device that can be placed in a lacrosse goal to decrease the open area of the goal.

BACKGROUND OF THE INVENTION

Lacrosse and other sports require a player to shoot a ball into a goal that is occupied by a goalie in order to obtain game points. The ability to shoot a ball with accuracy so that a player can get the ball around a goalie is an important skill that many players spend large amounts of time developing. However, many times players must practice goal shooting without a goalie present, which can make it difficult to mimic a game-time scenario. It can also cause a player to spend a lot of time recovering their ball after it has been shot into a goal, since there is no goalie present to return the ball to the player. Sometimes a goalie may not be present for an actual game, and it is necessary to find a way to mimic the presence of a goalie in order to make the game more competitive for the players.

Existing training aids for goal sports are not durable to withstand high speed shots, long use, nor are able to be easily set up on different goals in little time. Training aids also do not provide players with different options for whether they want shot balls quickly returned to them or not. Existing training aids also do not provide players with the option to quickly adjust the height or shape of the goal area and thereby adjust the skill needed to make a shot. Existing training aids also do not provide players with a moving target.

SUMMARY OF THE INVENTIVE CONCEPT

Consequently, there is a need for a training device that provides for a variety of different uses, is easily portable, and allows for quick and easy set-up and removal. Accordingly, exemplary embodiments of the training device according to the inventive concept meet these needs. The exemplary training devices are useful in practice, camps, clinics, pre-game warm-ups, testing for shooting, team tryouts, and tournaments if no goalie is present.

The training device of the inventive concept includes a frame. The frame may be rigid or modular. The frame may have support bars attached to its back side. A target material is provided inside the frame and connected to the frame. The training device may be suspended inside a lacrosse goal or it may have an associated stand when used without a lacrosse goal. The target material may be connected to the support bars or the frame by using elastic cords, metal springs, ties, or clips. The target material may also be made of elastic material, such as trampoline fabric, or netting. The target material may be shaped as a sleeve that can be slid over the frame.

The training device may be held upright in the lacrosse goal by using straps either attached to or passing through the frame. The straps suspend the training device and allow the training device to be moved horizontally within the goal. Although contemplated for use in a lacrosse goal, it should be understood that the training device may be used in any goal having two vertical bars, including, but not limited to, hockey goals, soccer goals, and goal posts. The training device may also have wheels so that it can be easily moved. The training device may also have a motor that allows it to move automatically. The motor may be controlled by an integrated controller that is attached to the training device, or a wireless remote controller. The wireless controller may be worn by a player or attached to a piece of equipment.

According to the inventive concept, an exemplary embodiment is a training device having a rectangular frame with support bars attached thereto. The training device has a target material that is removably attached to the frame. At least one strap, having two ends, is able to be connected on a first end of the strap to a first side of a goal, passed through the frame and support bars, and attached on its second end to a second side of a goal. The device has a pair of wheels attached to the frame, and a track underneath the wheels to provide a surface for the wheels to move the device from side to side. The training device has at least one retention member that holds the target material to the frame, which may be a tension cord that is looped through apertures in the target material and support bars. The retention member may also be one or more ties that pass through apertures in the target material and are removably affixed to the rectangular frame. The target material may be calendered trampoline fabric. The frame of the training device is segmented into first, second, third, and fourth segments, which are able to slide into one another to adjust the dimension of the frame. The training device may also have a target that is removably attached to the frame. The training device has a motor that is connected to the frame, the motor having a drive shaft that is in mechanical communication with the wheels. The drive shaft is mechanically connected to the wheels through a chain, and a controller may be used for controlling operation of the motor. The controller may be either wired or wireless. The target material may slide over the frame.

According to the inventive concept, an exemplary embodiment is a training device comprised of a rectangular frame, a target material removably attached to the frame, wheels attached to the frame, and a motor attached to the frame in mechanical communication with the wheels, where the motor is arranged to supply rotational motion to the wheels. The training device has at least one strap that supports the frame and allows the frame to move side-to-side within a goal when rotational motion is applied to the wheels. The training device has a controller that controls the motor, which may be a wired controller attached to the motor, or a wireless controller that communicates with the motor through a wireless sensor connected to the motor. The training device has a track positioned beneath the wheels that provides a smooth surface for the wheels to traverse. The training device is segmented so that it is collapsible or foldable.

According to the inventive concept, an exemplary embodiment is a training device having a segmented rectangular frame where the segments allow the frame to be dimensionally adjusted, an elastic target material removably attached to the frame, and wheels attached to the frame. The training device has a motor attached to the frame that is in mechanical communication with the wheels, and the motor arranged to supply rotational motion to the wheels. The training device has at least one strap supporting the frame and allowing the frame to move side-to-side within the goal when rotational motion is applied to the wheels. The training device also has a wireless controller for directing the motor to apply directional motion to the wheels. The training device has a track underneath the wheels to provide a smooth surface for the wheels to traverse.

DETAILED DESCRIPTION

Figure 1:
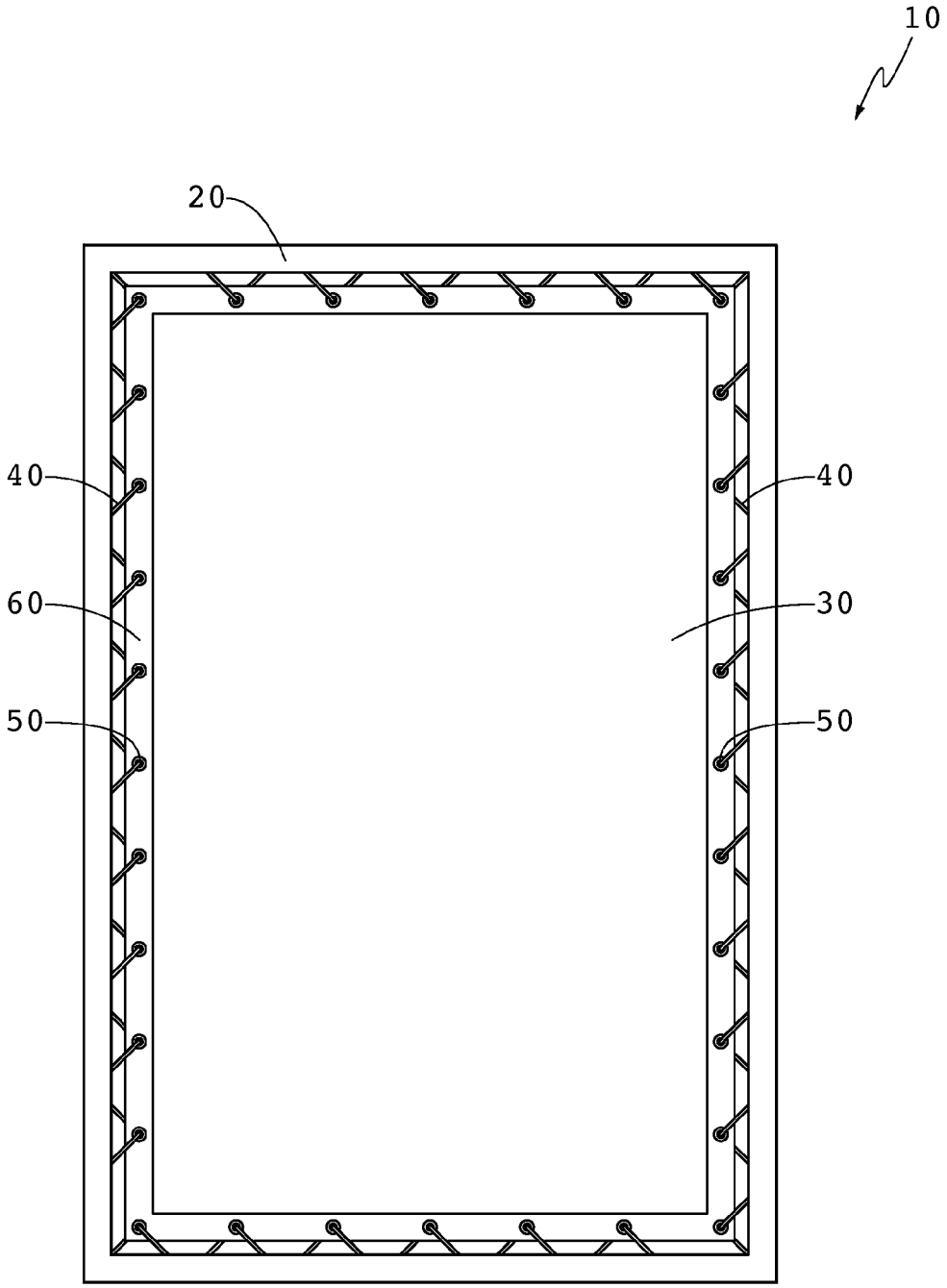
FIG. 1 is a front view of a first exemplary embodiment of a lacrosse training device.

FIG. 1 is a front view of an exemplary embodiment of a lacrosse training device 10 of the inventive concept. The training device 10 includes a rectangular frame 20 surrounding a piece of target material 30. In the embodiment shown, the target material 30 has apertures 50 therein. A tension cord 40 is looped through the apertures 50 in the surface of the target material 30 in order to hold the target material 30 in place within the perimeter of the frame 20. The tension cord 40 is able to be removed from the device 10, thereby allowing for removal of the target material 30. The tension cord 40 may be made from any natural or synthetic material and may be rigid or elastic. In some embodiments, the tension cord 40 may be made of rope, and in other embodiments the tension cord 40 may be made of cable or other materials. The ends of the tension cord 40 may be tied together and pulled as tight as necessary in order to hold the target material 30 in place with the desired tension. The target material 30 may have reinforced edges 60 around the perimeter to provide added strength around the apertures 50.

Figure 2:
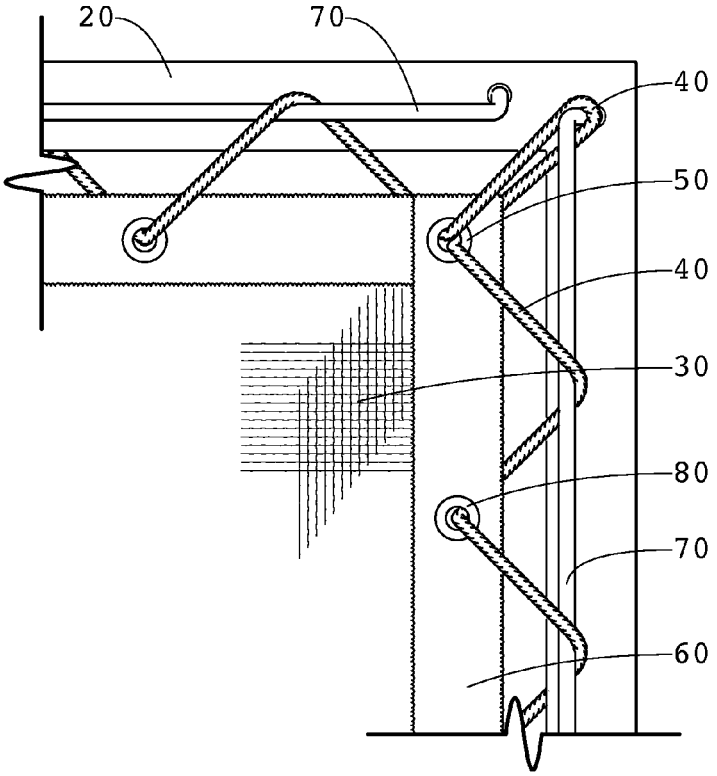
FIG. 2 is a perspective view of a portion of the rear of the exemplary embodiment of the lacrosse training device of FIG. 1.

FIG. 2 is a rear perspective view of the exemplary embodiment of the lacrosse training device 10 of FIG. 1. As shown, the back of the frame 20 is connected to rigid support bars 70 that are each positioned parallel to one side of the frame 20. Additional support bars (not shown) run parallel along the other sides of the frame 20, such that there are four support bars 70 associated with the frame 20. The supports bars 70 are fixed to the frame 20. As shown in FIG. 2, the supports bars 70 may be welded to the frame 20; however, it should be understood by those skilled in the art that the support bars 70 may be securely fastened to the frame 20 by other means, including, but not limited to, mechanical fasteners and adhesives. In some embodiments, the support bars 70 and frame 20 may be made from one continuous piece of material, such as extruded plastic. In some embodiments the support bars 70 may be bent on one or both ends and then connected directly to the frame 20. In other embodiments, the support bars 70 may be straight and connected at an angle to short segments of the same or different material that is then connected to the frame 20, in order to provide space for the tension cord 40 to pass through.

Each support bar 70 is positioned relative to its corresponding side of the frame 20 such that there is enough space in-between the support bar 70 and the frame 20 for the tension cord 40 to fit therebetween. The tension cord 40 is looped through the apertures 50 in the target material 30 and around the support bars 70. To prevent tearing of the target material 30, the apertures 50 may be surrounded by grommets 80 as illustrated in FIG. 2. In some embodiments, a number of support bars 70 may be connected to the frame 20 and positioned such that each support bar 70 corresponds to an aperture 50 in the target material 30.

In the exemplary embodiments shown in FIGS. 1 and 2, the tension cord 40 is looped through the apertures 50 in the target material 30 and around the support bars 70 along the perimeter of the frame 20. The ends of the tension cord 40 are secured by tying the ends together or by other means. In some exemplary embodiments, the tension cord 40 may have an associated ratchet. In embodiments having a ratchet, the ratchet may be used to tighten the tension cord 40 and securely fasten the ends thereof. The firmness of the target material 30 is controlled by how tightly the tension cord 40 is looped through the target material 30 and around the support bars 70. In this manner, the target material 30 may be made taut and firm or it may have some degree of slack in it. How firm a user wishes the target material 30 to be is dependent on the desired use of the training device 10. If a user desires that a ball shot at the training device 10 bounce back out onto the playing field, then it may be preferable to have the target material 30 firm. If a user desires that balls shot at the training device 10 simply fall to the ground near the base of the device 10, then it may be preferable to have slack in the target material 30. Depending on the various situations in which the training device 10 is used, the tension cord 40 may be tightened or loosened accordingly.

In the exemplary embodiment shown in FIGS. 1 and 2, the frame 20 is made from four pieces of steel pipe that have been welded together at each corner; however, it should be understood by those of skill in the art that the frame 20 may be made of any other rigid metal or non-metal material, such as aluminum, plastic, wood, fiberglass, or other similar materials capable of withstanding the tensions applied to the target material 30 and impacts from lacrosse balls. Depending on the embodiment, the frame 20 may have a unitary design formed from a single piece of material. As with the frame 20, the support bars 70 may be made from a variety of metal or non-metal materials capable of withstanding the forces associated with the lacrosse training device 10, including, but not limited to, aluminum, plastic, wood, fiberglass and other similar materials. In the embodiment shown in FIGS. 1 and 2, there are four support bars 70 associated with the rectangular sides of the frame 20; however, it should be understood that the support bars 70 may be a continuous piece of material having a rectangular shape rather than four individual support bars 70. Furthermore, it should be understood that depending on the embodiment, the support bars 70 may be a variety of shapes that generally match the shape of the frame 20. For example, in some embodiments the frame 20 may be shaped like the silhouette of a goalie, and the support bars 70 may have a similar or identical shape in order to keep the target material 30 taut. In other embodiments the frame 20 may have other desirable shapes, and the support bars 70 have corresponding shapes in order to hold the target material 30 in the desired position.

While in the embodiment of FIGS. 1 and 2, the frame 20 is made of round pipe and the support bars 70 are flat bars, in different embodiments the frame 20 and support bars 70 may have different shapes as desired.

In the exemplary embodiment of FIGS. 1 and 2, the target material 30 is calendered trampoline fabric, which makes it highly durable. However, in other embodiments different types of materials, including but not limited to, other fabrics, mesh, webbing, netting, metal, wood, or plastic may be used. It may be preferable that the target material 30 have some elasticity to it so that it can absorb some of the energy of balls being thrown at it. Also, while the target material 30 in FIGS. 1 and 2 has a reinforced edge 60, in other embodiments the target material 30 may not have a reinforced edge 60. In some embodiments, images may be placed on the target material 30, such as team mascots, logos, or commercial advertisements.

Figure 3:
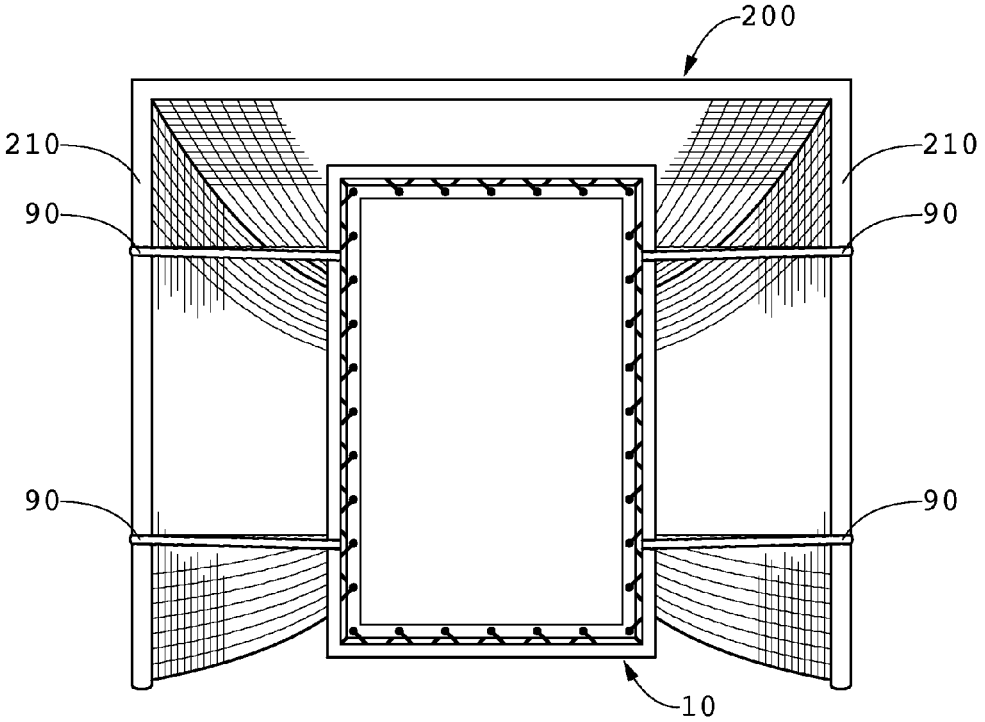
FIG. 3 is a front view of the lacrosse training device of FIG. 1 being used in association with a lacrosse goal.

FIG. 3 illustrates a front view of an exemplary lacrosse training device 10 being used in association with a lacrosse goal. As shown, a training device 10 has been positioned in the opening of a lacrosse goal 200. Straps 90 may be used to wrap around the posts 210 of the lacrosse goal 200 and hold the training device 10 upright. The straps 90 may have hooks on either end that can easily be connected to the support bars 70 on the back of the training device 10 or to the frame 20 itself. In some embodiments one end of the straps 90 may be permanently fixed to the back of the training device 10 with a hook on the other end that can be swung around the posts 210 and then hooked on the support bars 70, back to itself, or directly to the goal posts 210. In different embodiments the straps 90 may use Velcro™, buckles, snaps, or other means for connecting to the back of the training device 10. The straps 90 may be made out of rubber, metal cable, rope, cloth, or any other material that can hold the training device 10 in an upright position.

In another exemplary embodiment, instead of using four straps 90, two straps 90 may be utilized. In this embodiment, the straps 90 may pass through the frame 20, or between the frame 20 and support bars 70. Thus, enabling the training device 10 to slide horizontally along the straps 90. In addition, by decreasing the number of straps 90, the time required to install the training device 10 in a lacrosse goal may be decreased.

The training device 10 shown in FIGS. 1-3 can be used in different ways. If the target material 30 is taut, a player in the field can shoot a ball directly at the target material 30 and the ball will bounce back into the field. This can allow a player to practice taking many shots without having to spend the time to retrieve balls out of the goal or near the training device 10. If the tension cord 40 is loosened and the target material 30 has a sufficient amount of slack in it, a player can shoot a ball at the training device 10 and the ball will not rebound back into the playing field, but may instead fall to the bottom of the training device 10, or near thereto.

A player can also practice shooting around the training device 10 and into the space between the training device 10 and the goal posts 210, which can increase their skill in shooting around a goaltender during a game time situation. A player can also play games such as "Around the World." In this game, the player attempts to shoot a ball into each delineated space that has been created by the training device 10 and straps 90, and attempts to go around the training device 10 in either a clockwise or counter-clockwise fashion, aiming to consecutively shoot balls on the first try into each delineated space. In some embodiments, one or more straps 90 may be connected to the top of the training device 10 or in other places around the training device 10 in order to create a multitude of different combinations of delineated spaces that a player can use for target practice. In these embodiments, the player may move the straps 90 to different locations around the training device 10 to create delineated spaces for target practice as desired. However, it should be known that targets can be attached to the frame 20 to create additional shooting opportunities.

Figure 4:
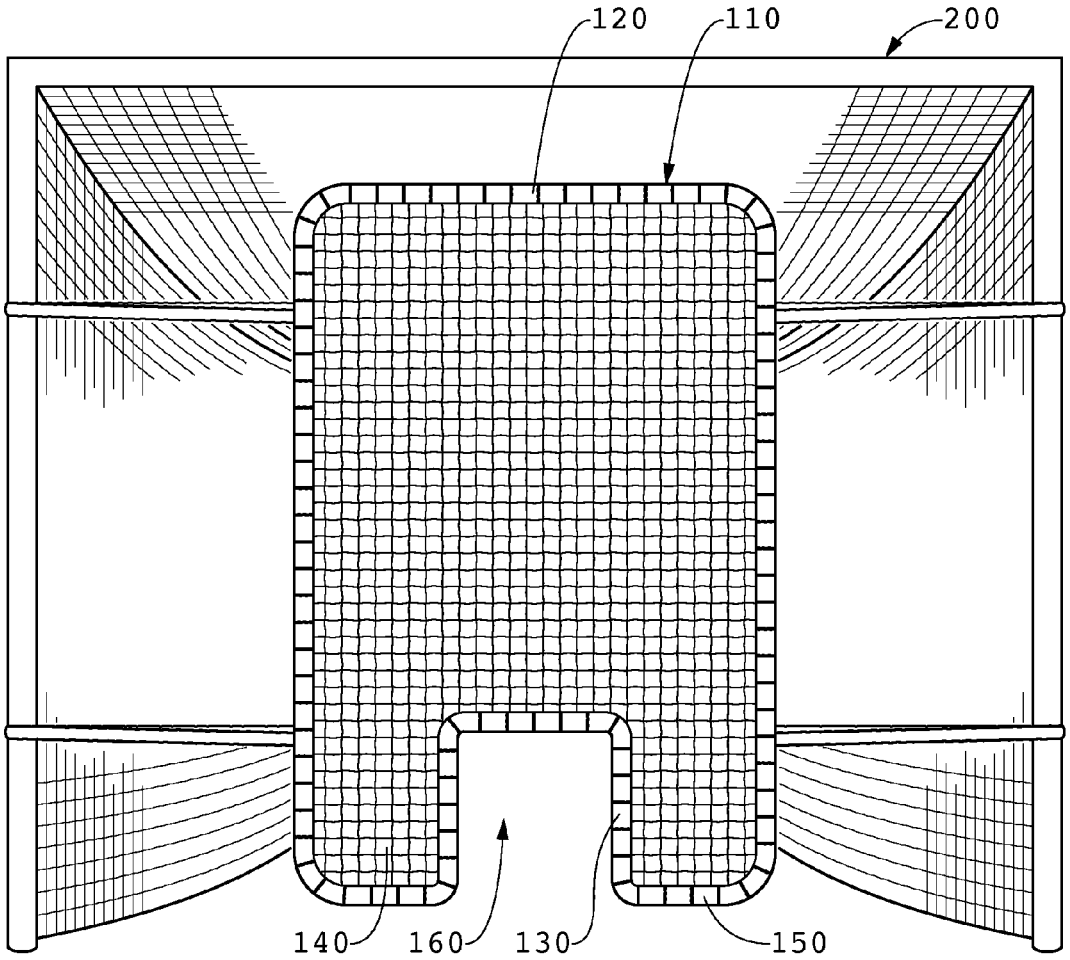
FIG. 4 is a front view of a second exemplary embodiment of a lacrosse training device.

FIG. 4 illustrates a front view of an exemplary embodiment of a lacrosse training device 110 as shown. In this embodiment, the frame 120 of the training device 110 is substantially rectangular with a square cutout 130 on its bottom end. Netting 140 is held across the frame 120 by a cord 150 that wraps through the netting 140 and around the frame 120. The cutout 130 at the bottom of the training device 110 creates a passthrough 160 into the goal 200 behind the training device 110. The passthrough 160 creates a target for a player to practice their shooting skills on. In different embodiments, the passthrough 160 may be of a different shape or location. In some embodiments, the netting 140 may have an aperture in it that also provides target practice for a player. In some embodiments, the frame 120 may be rectangular, with no cutouts. Although this embodiment uses netting 140 in the training device 110, it should be understood that different target material and support bars may be used with this embodiment if desired. In addition, it should also be understood that the training device 110 may take on a variety of shapes other than rectangular. The training device 110 may also be shaped similar to a goalie or shaped to train particular types of shots.

Figure 5:
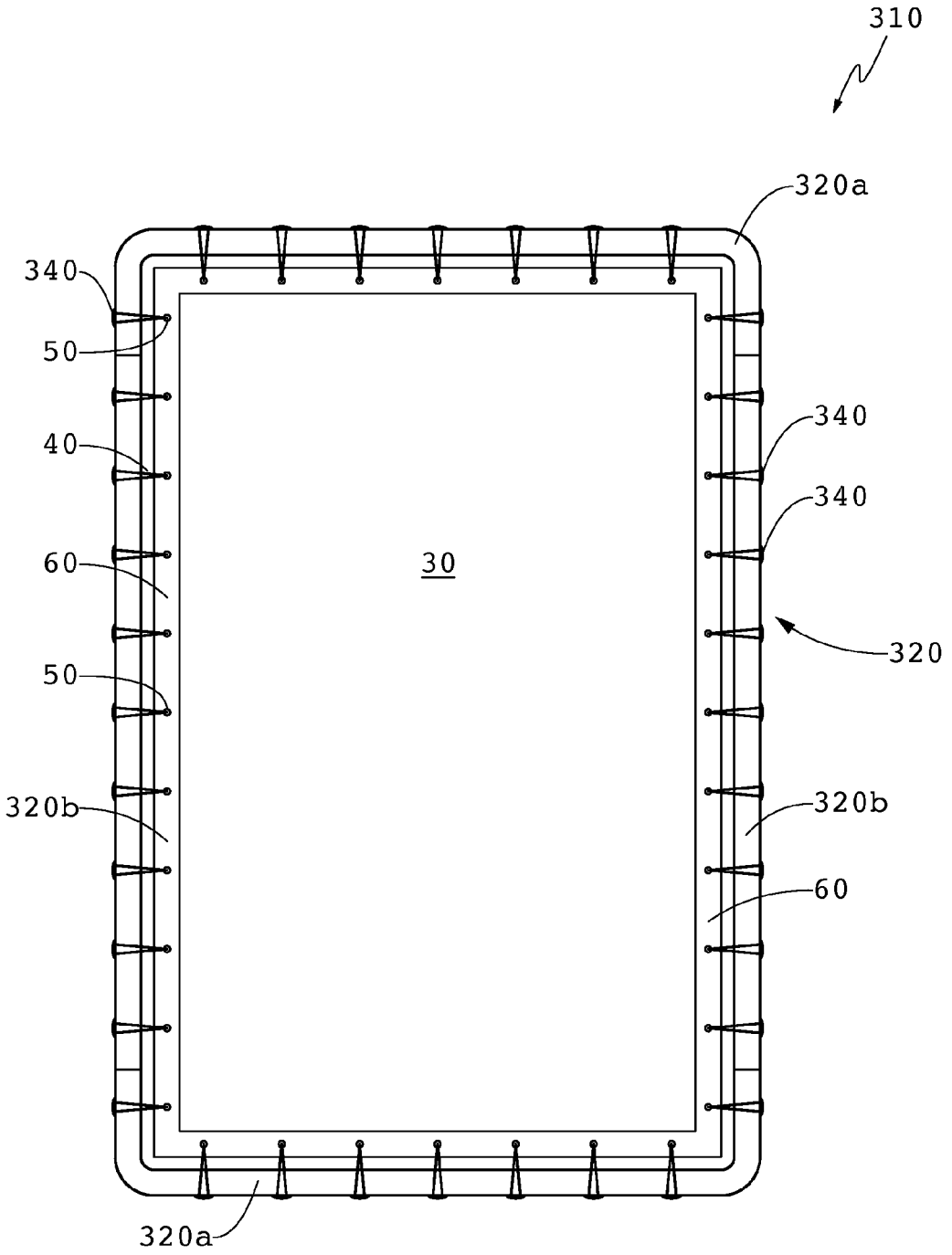
FIG. 5 is a front view of a third exemplary embodiment of a lacrosse training device according to the inventive concept.

FIG. 5 is another exemplary embodiment of a lacrosse training device 310. In this embodiment, the training device 310 is made of a modular frame 320 having horizontal portions **320*a* and vertical sections 320*b* framing a piece of target material 30. According to the embodiment in FIG. 5, the horizontal and vertical portions 320*a*, 320*b* are designed to removably lock one to another to form the frame 320. Biased locking pins may be used to connect the horizontal and vertical sections 320*a*, 320*b*. In other exemplary embodiments the connections may be made by threaded couplings or other similar devices capable of securely and removably connecting the horizontal and vertical sections 320*a*, 320*b* to one another. In still other exemplary embodiments, the frame 320 may be hinged allowing for the frame 320** to be folded easy for installation and removal. It will be appreciated to one of ordinary skill in the art that a number of embodiments having means of folding and/or collapsing the training device exist, including, but not limited to, those incorporating spring loaded hinges, latches, pins, and spring-loaded pins. Furthermore, it will be recognized by one of ordinary skill in the art that many different types of hinges, latches, pins, spring-loaded pins, and other mechanisms may be used in different exemplary embodiments where the frame may be divided into any number of segments that allow for the desired collapsing or folding effect.

Instead of a singular tension cord 40, the embodiment in FIG. 5 utilizes individual ties 340 associated with the apertures 50 in the target material 30. The ties 340 are threaded through the apertures 50 in the target material 30 and wrapped around the frame 320. After being wrapped around the frame 320, the tie 340 is then temporarily fixed to itself, thus creating an elastic connection between the frame 320 and the target material 30. As with other exemplary embodiments, the target material 30 may have a reinforced edge 60 around its perimeter to provide added strength around the apertures 50. Grommets 80 may also be used to reinforce the apertures 50. The ties 340 may be removable, thereby allowing the target material 30 to be removed.

Figure 6:
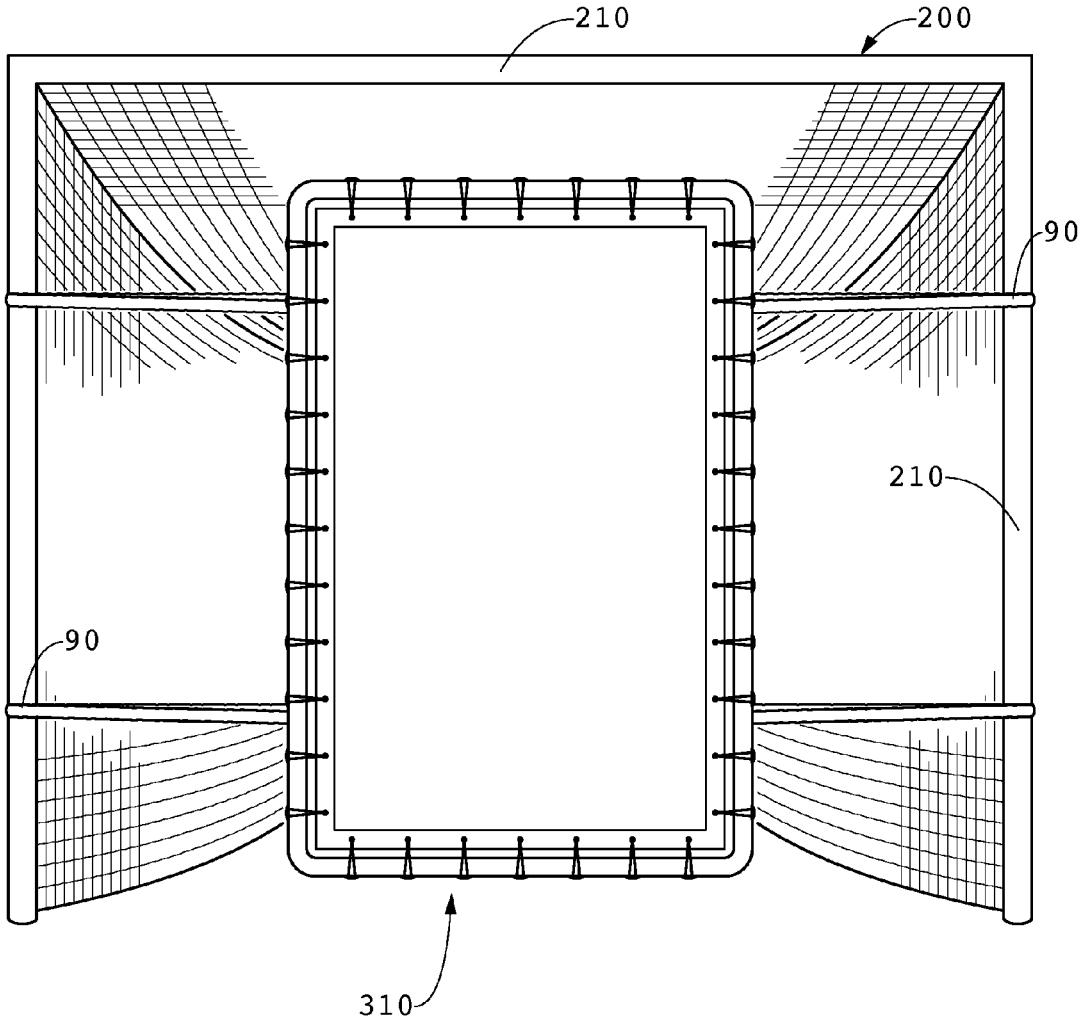
FIG. 6 is a front view of the exemplary training device of FIG. 5 being used in association with a lacrosse goal.

FIG. 6 illustrates an exemplary embodiment of a lacrosse training device 310 used in association with a lacrosse goal. As shown in FIG. 6, a training device 310 has been positioned in the opening of a lacrosse goal 200. Straps 90 may be used to wrap around the post 210 of the lacrosse goal 200 and hold the training device 310 upright. The straps 90 may have hooks on either end that can be easily connected to the opposing posts 210 of the lacrosse goal 200. It should be understood that the straps 90 may connect to the posts 210 in a variety of different ways facilitating the removal and installation of the training device 310, including, but not limited to, Velcro™, mechanical fasteners, buckles, snaps, or other similar attachment means. Depending on the embodiment, the straps 90 may attach to the training device 30 in different ways, including, but not limited to, hooks, Velcro™, mechanical fasteners, buckles, snaps, or other attachment means. In some embodiments, one end of the straps 90 may be hooked onto the support bars 70, the straps 90 wrapped around the posts 210, and the other end of the straps 90 hooked on the support bars 70 as well, or the straps 90 may be attached back on themselves with a variety of attachment means, or they may be attached to another part of the training device 310. It should be appreciated by one of ordinary skill in the art that any number of straps 90 may be fixed to different locations of the training device 310 and the lacrosse goal 200 using many different methods and attachment means in order to achieve the desired positioning as well as to make setup and take down of the device easy and quick.

In this embodiment, the frame 320, specifically the vertical sections 320*b*, have holes 350 (shown in FIG. 7) therein to allow the straps 90 to pass therethrough. This configuration assists in holding the training device 310 upright while allowing the training device 310 to be moved easily horizontally along the straps 90. This provides an added feature allowing a user to quickly and easily move the training device 310 within the goal 200 to practice specific shots.

Figure 7:
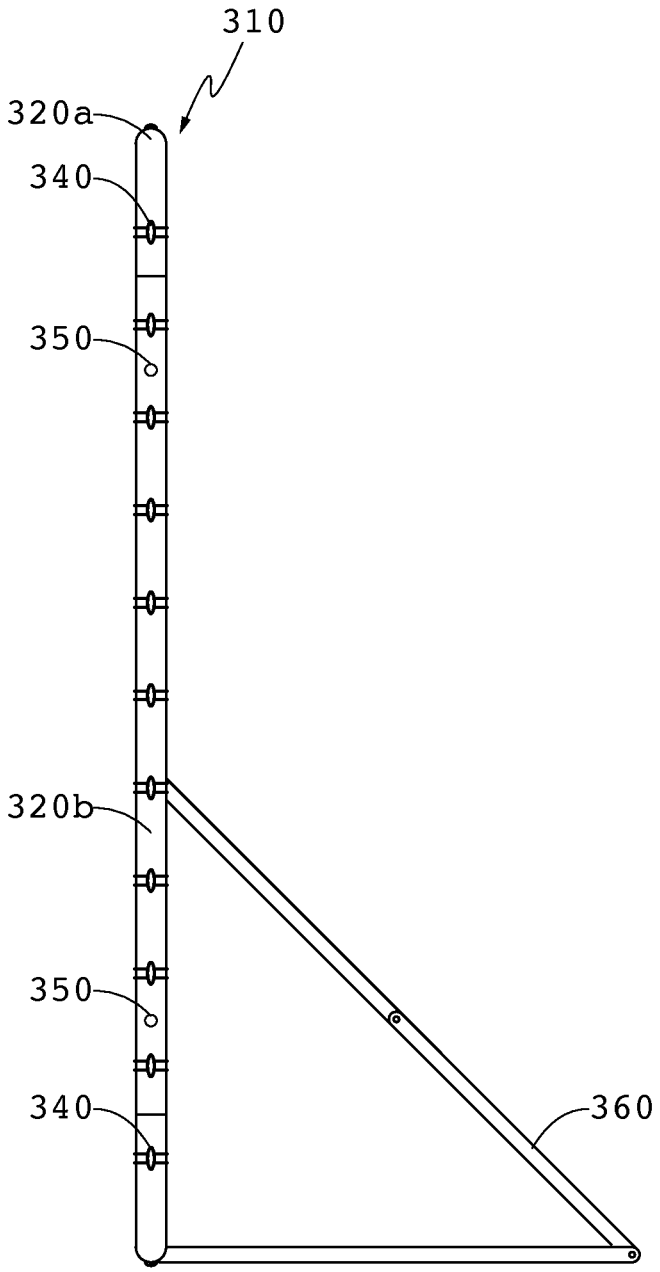
FIG. 7 is a side view of the exemplary training device of FIG. 5 having an optional stand attached thereto.

FIG. 7 is a side perspective of the exemplary training device 310 having an optional stand 360. As shown in FIG. 7, the training device 310 is made of modular frame sections 320*a*, 320*b*. The target material 30 is held in place by ties 340. The vertical sections 320*b* of the frame 320 have holes 350 therein allowing straps 90 to pass through the frame 320. To prevent fraying of the straps 90 the holes 350 may have plastic inserts preventing contact between the strap 90 and the frame 320. This would allow the training device 310 to slide easily along the straps 90 without the unnecessary wear on the straps 90.

As illustrated in FIG. 7, the exemplary training device 310 has an optional stand 360. The stand allows the training device 310 to stand upright when no straps 90 are used. When the stand 360 is not needed, it may simply be folded out of the way when straps 90 are used. This feature allows the training device 310 to be used without the need of a lacrosse goal 200. Although FIG. 7 illustrates one particular embodiment of a foldable stand 360, it should be understood by those of skill in the art that a number of different embodiments of folding or removable stands may be used with the training device 310.

In the exemplary embodiments described herein, the frame 320 of the training device 10, 310 is approximately 70 inches tall and 38 inches wide, and is made from pipe having a diameter of between 1 and 4 inches. However, it should be understood that other dimensions may be used depending on the desired use of the training device 10, 310. Also, as discussed above, in the exemplary embodiments described herein, the training device 10, 110, 310 and frame 20, 120, 320 may be any shape desired.

Figure 8:
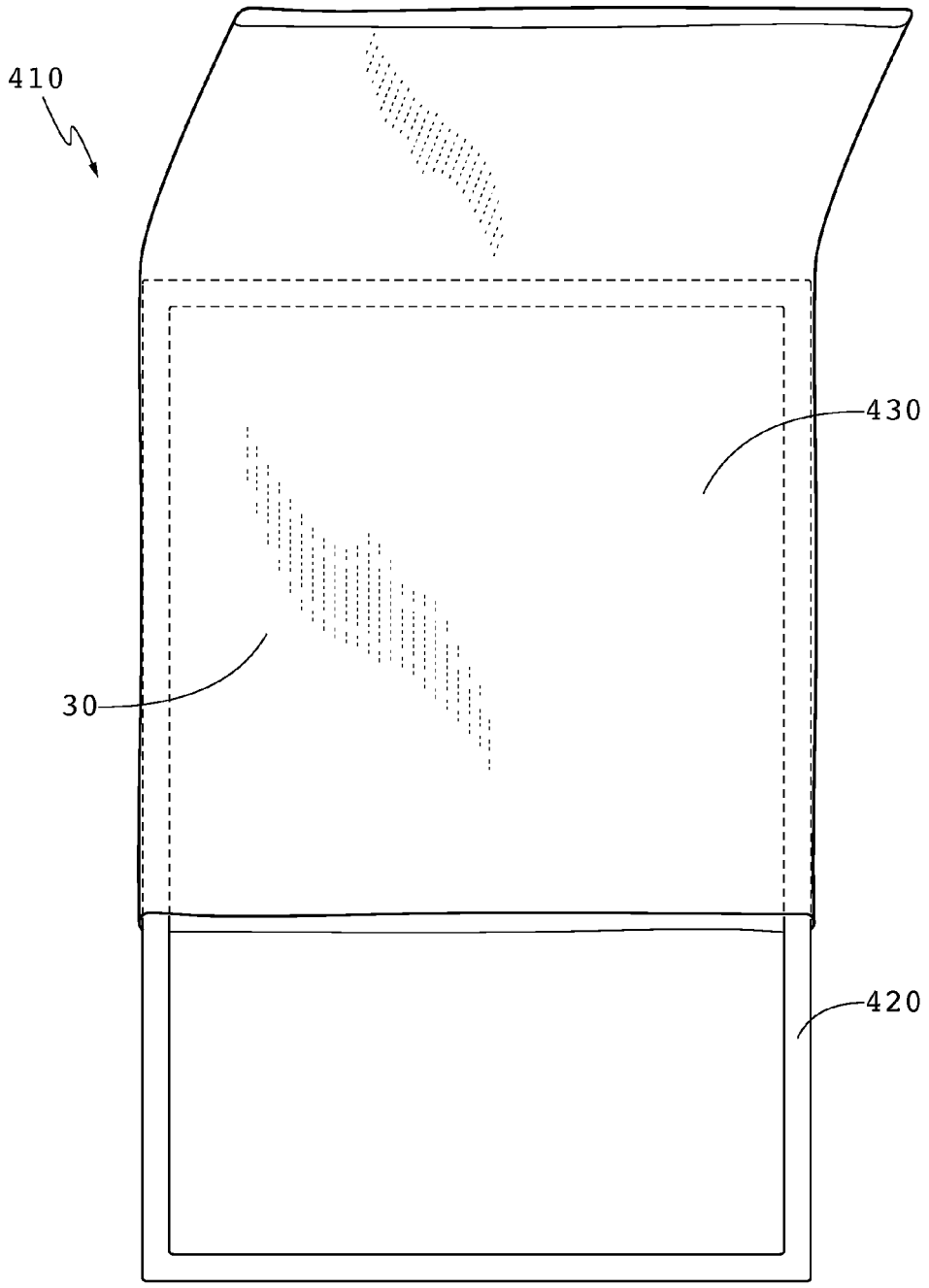
FIG. 8 is a front view of a fourth exemplary embodiment of a lacrosse training device.
Figure 9:
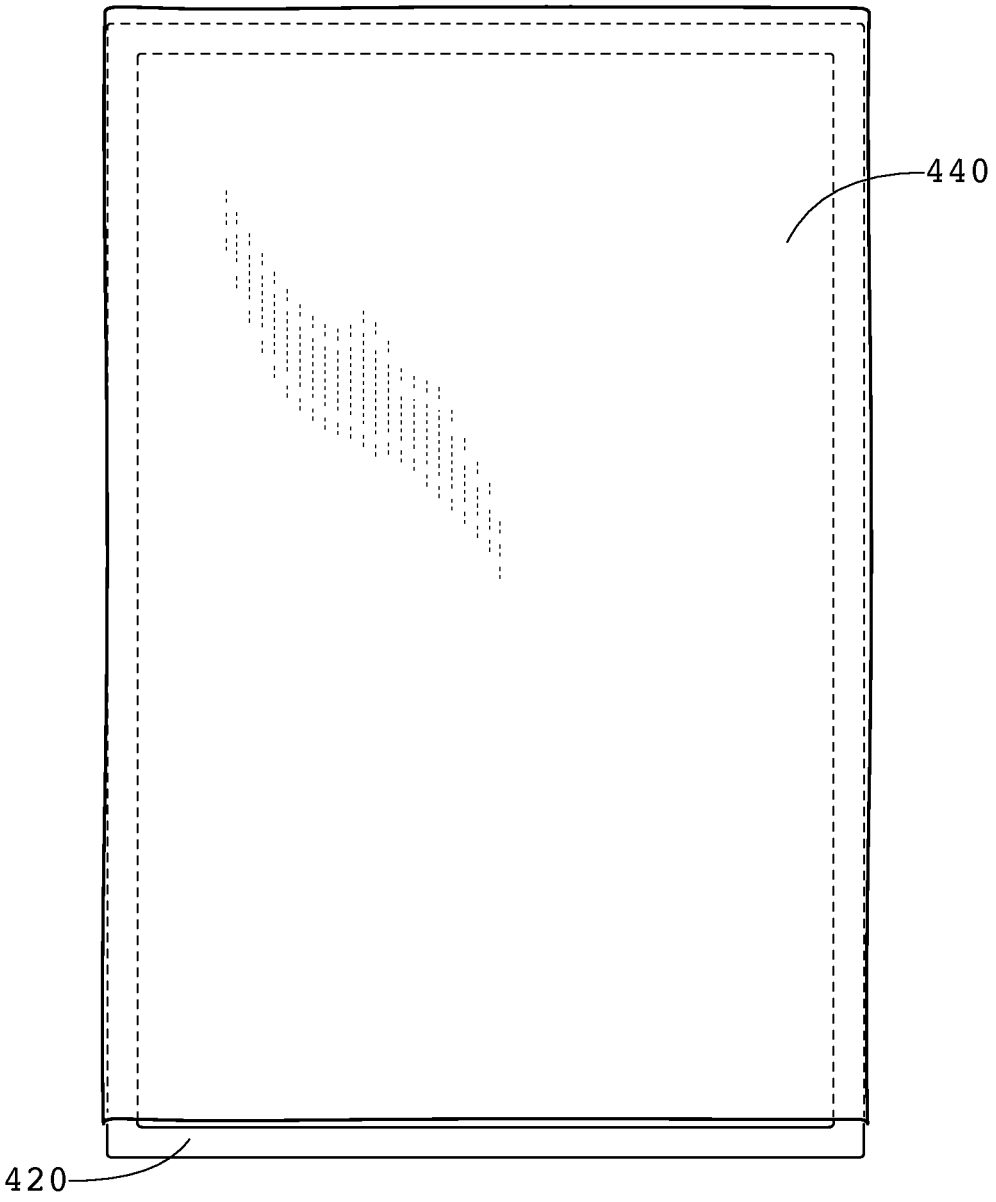
FIG. 9 is a front view of a fifth exemplary embodiment of a lacrosse training device.

As illustrated in FIG. 8, in some embodiments of the present invention the training device 410 consists of a rectangular frame 420 and target material 30 that is sewn together into a target sleeve 430. That is, two pieces of rectangular target material 30 are sewn together along their two matching sides, leaving the top and bottom side of the sleeve open and sized to slide over the frame 420. When use of the training device 410 is desired, the target sleeve 430 can be slid down over the frame 420, such that the target material 30 covers all or a substantial portion of the frame 420. The target sleeve 430 may be sized such that it is taut when pulled down onto the frame 420. Different types of material having different elasticities can be used to create multiple target sleeves 430 for the same frame 420. As illustrated in FIG. 9, in some embodiments the target sleeve 440 may also be sewn shut across the top. In some embodiments the target sleeve 430, 440 may contain apertures to allow the passing of straps, hooks, or other items through the target sleeve 430, 440 and to the frame 420, allowing the frame 420 to be held in a desired location within a goal, or otherwise connected to a structure as desired.

Figure 10:
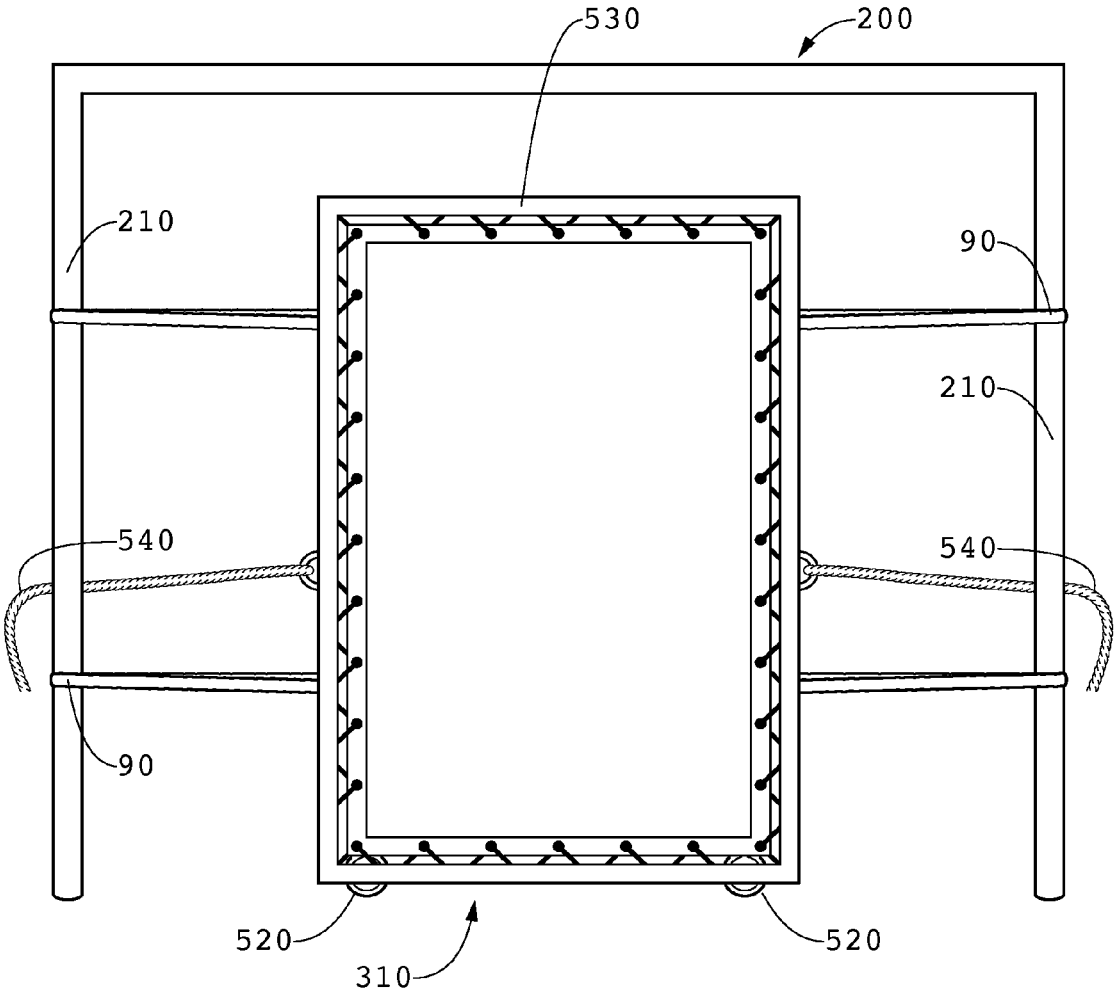
FIG. 10 is a front view of a sixth exemplary embodiment of a lacrosse training device.
Figure 11:
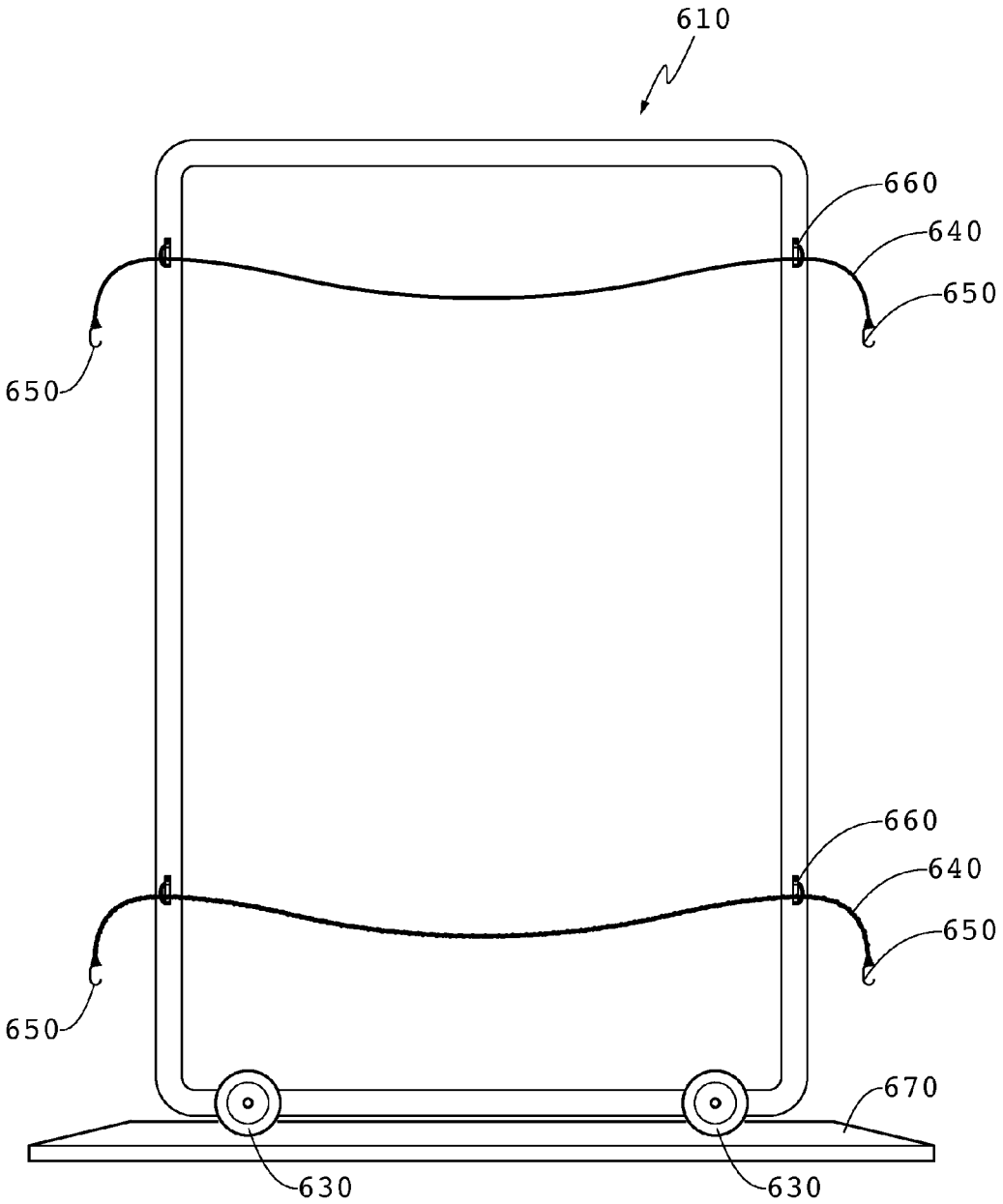
FIG. 11 is a perspective view of a seventh exemplary embodiment of a lacrosse training device.
Figure 12:
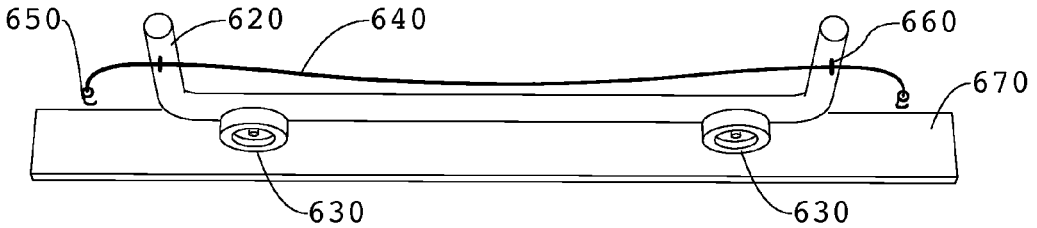
FIG. 12 is a perspective view of the wheels of the exemplary embodiment of FIG. 11.
Figure 13:
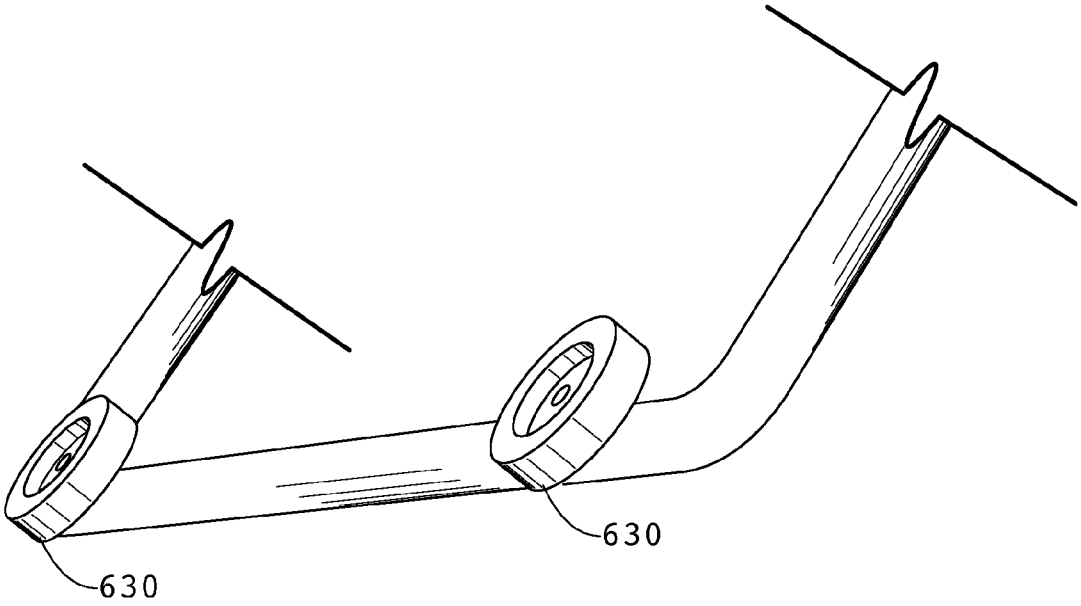
FIG. 13 is a perspective view of the wheels of the exemplary embodiment of FIG. 11.
Figure 14:
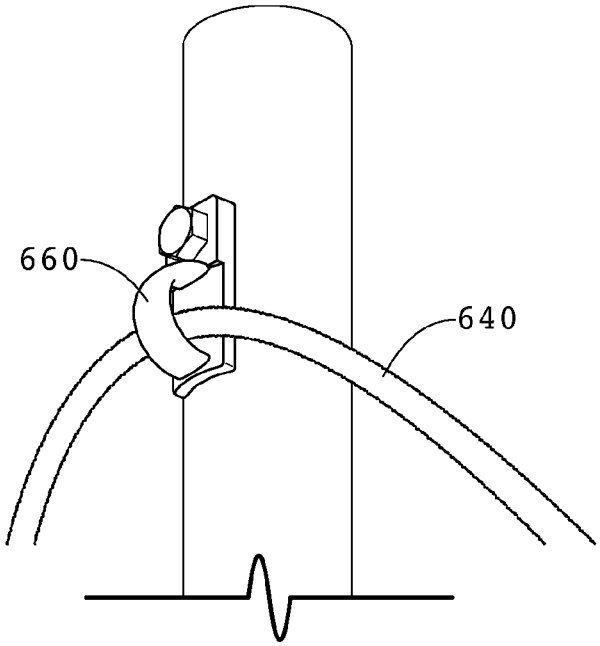
FIG. 14 is a perspective view of a bracket and pull strap of the exemplary embodiment of FIG. 11.

In some embodiments, the training device may have one or more wheels on it that allow it to be rolled into the desired location. In these embodiments the training device may be moved across the front of a goal with ease, and in those embodiments where the training device has straps that pass through the frame and can be attached to both sides of the goal, wheels on the bottom of the device may allow the device to slide from side to side along the straps across the goal. In some embodiments the sides of the frame may have one or more ropes or straps connected thereto in order to allow someone to direct the movement of the device. In some embodiments the rope or strap may be long enough that someone standing behind a goal in which the device is located can move the device by pulling on the ropes or straps. In other embodiments the ropes or straps may be attached to the frame or other parts of the training device in different locations in order to achieve the desired movement of the device. Referring to FIG. 10, an exemplary embodiment of a training device 510 with two wheels 520 rotatably attached to the frame 530 and pull straps 540 attached to either side of the frame 530 is shown. In this embodiment the wheels 520 allow the training device 510 to slide along the support straps 90, which pass though the frame 530 and do impede the training device's ability to move side to side. In other embodiments, the wheels 520 may sit on or in a track that is placed on the ground and across the front of the goal or other location. Through the use of wheels set in a track, the device may slide easily across the length of the track. Referring to FIGS. 11 and 12, an exemplary embodiment (no target material or support bars shown) of a training device 610 is shown where the frame 620 has two wheels 630 rotatably attached on its bottom. Two pull straps 640 with hooks 650 on both ends run across the width of the frame 620. The pull straps 640 are held in a relative position to the frame 620 by two sets of brackets 660 located on each side of the frame 620. In other embodiments, different means for holding the pull straps 640 in the desired locations may be used. Also, while in this embodiment the brackets 660 are located towards the top and bottom sides of the frame 620, in different embodiments the brackets 660 or other means for holding the pull straps 640 may be located in different locations on the frame 620. A smooth track 670 located beneath the wheels 630 allows the wheels 630 to move from side to side with less difficulty than the wheels 630 would experience on grass or dirt. Referring to FIG. 13, a perspective view of the wheels 630 of the embodiment of FIGS. 11 and 12 is shown. Referring to FIG. 14, a perspective view of a bracket 660 with a pull strap 640 running through is shown. In other embodiments of the present invention the track 670 may have grooves in it that guide the movement of the wheels 630. In other embodiments different types of wheels may be used.

Figure 15:
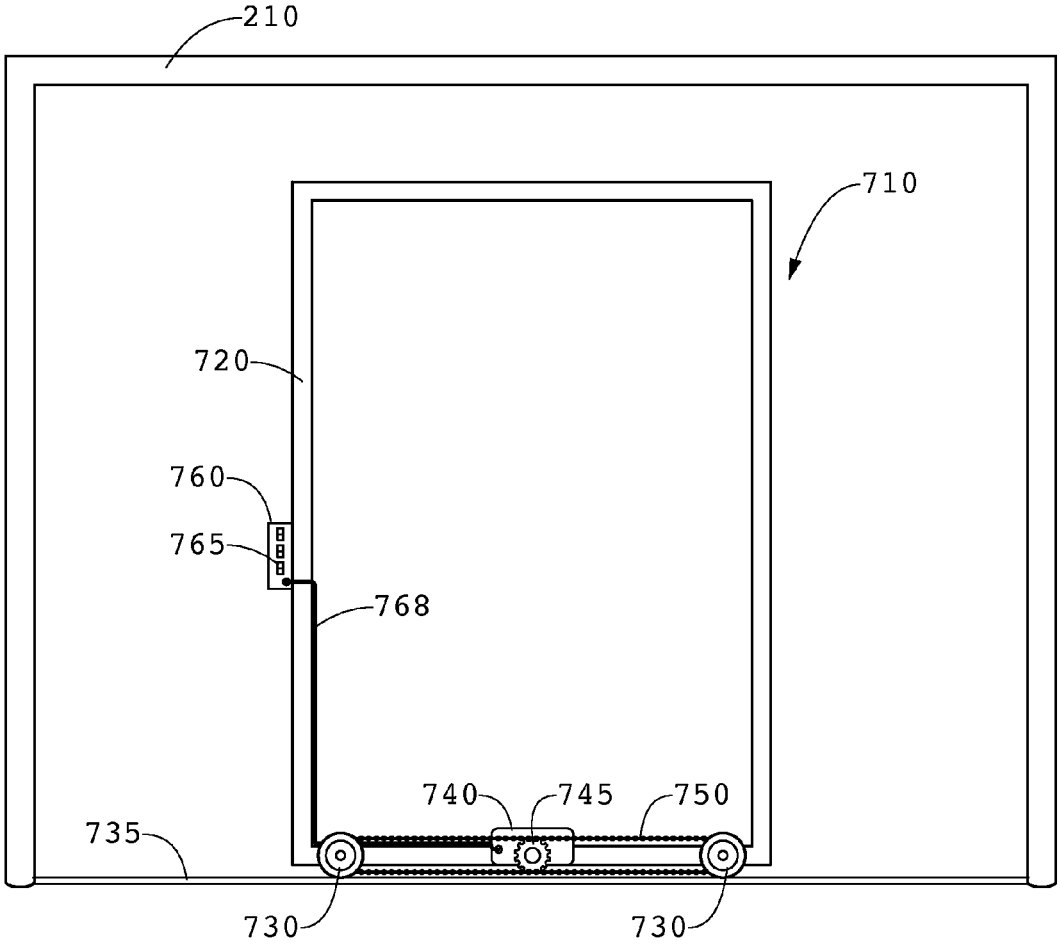
FIG. 15 is a front view of an eighth exemplary embodiment of a lacrosse training device.

In other embodiments, different means may be used to allow the device to move across the goal, across the rest of the playing field, or on and off the playing field as desired. In some exemplary embodiments, the training device may move along a track with the aid of a motor. Referring to FIG. 15, an exemplary embodiment (no target material shown) of a training device 710 is shown where the frame 720 has two wheels 730 rotatably attached to its bottom side, and the wheels 730 are set inside a grooved track 735. A motor 740 is attached to the frame 720 between the two wheels 730. A circular chain 750 is wrapped around both wheels 730, and is engaged with the motor 740. The motor 740 and chain 750 are connected in such a way that when the motor 740 is running, a drive sprocket 745 associated with the motor 740 is able to move the chain 750 in one direction or another, thereby causing the wheels 730 to move along the track 735. The chain 750 is able to cause movement of the wheels 730 by engaging with gears (not shown) attached to the back of the wheels 730. This in turn causes the training device 710 to move to one side or another along the length of the track 735. The motor 740 may be attached to a power source (not shown), such as a remote electrical power source through a power cord, or it may be connected to a battery that is connected to the motor 740. In some embodiments the battery and motor may be contained within a housing that protects them from weather and being hit by a player or ball. It will be understood by one of ordinary skill in the art that there are many different motors that can be used, and that there are many different ways in which to set up a motor assembly to move the training device 710, including but not limited to those using chains, in order to cause movement of the wheels 730 along the track 735.

In some exemplary embodiments the movement of the training device 710 may be controlled by a controller 760 with buttons 765 that is fastened to the frame 720 or other part of the training device 710 or even to the goal 210. The controller 760 may allow a player to move the training device 710 into different positions along the track 735 using the buttons 765. In some embodiments, such as that shown in FIG. 15, the controller 760 is connected to the motor through a communication cord 768. However, in other embodiments the controller 760 may be directly connected to the motor.

Figure 16:
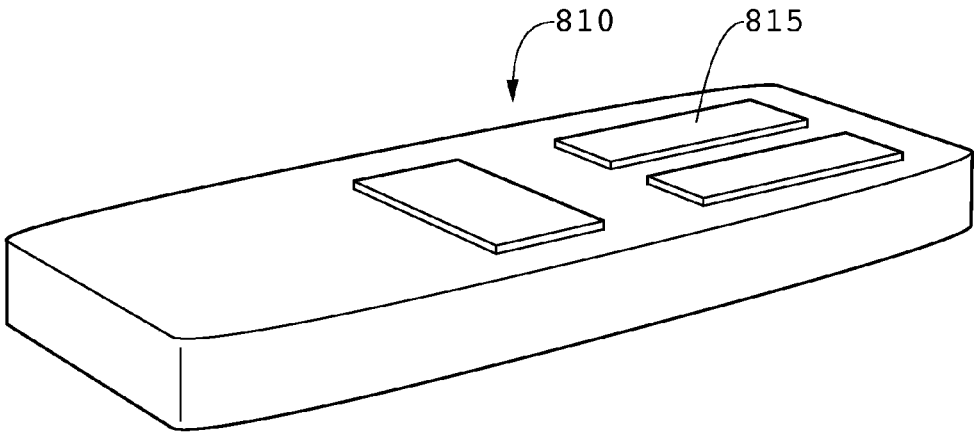
FIG. 16 is a perspective view of a first embodiment of a wireless controller for directing movement of a lacrosse training device.
Figure 17:
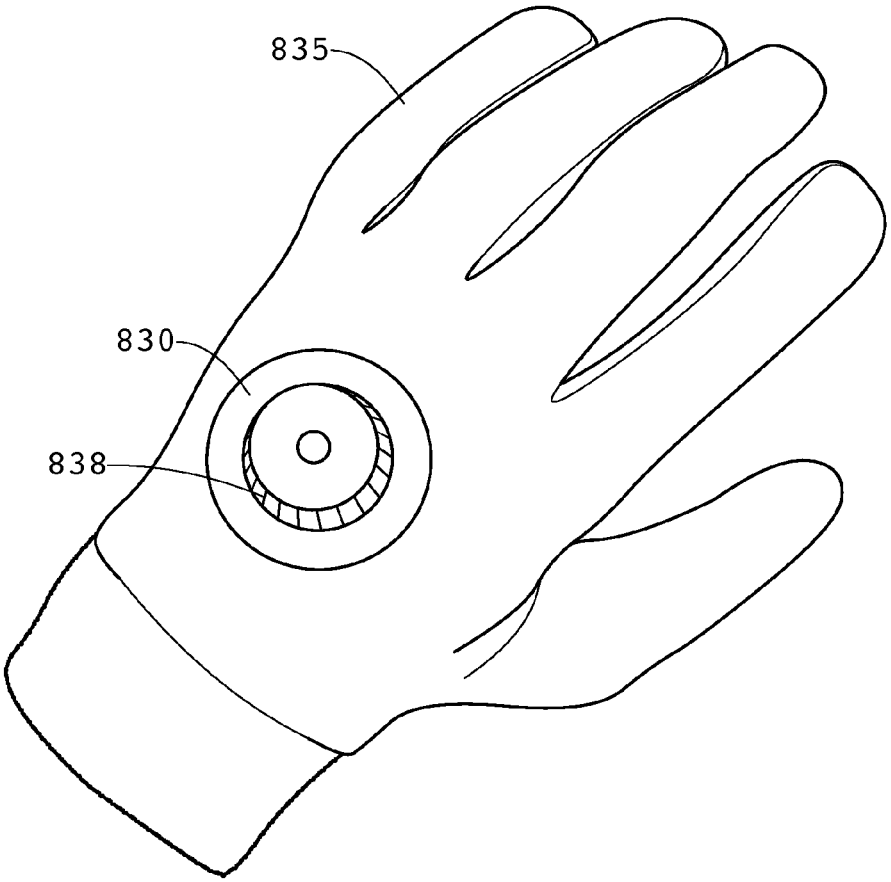
FIG. 17 is a perspective view of a second embodiment of a wireless controller for directing movement of a lacrosse training device.

In some exemplary embodiments, a wireless controller may be used to move a training device. Referring to FIG. 16, an exemplary embodiment of a wireless controller 810 is shown. The wireless controller 810 has buttons 815 to control movement of a training device along the track. In this embodiment, the wireless controller 810 communicates with a wireless sensor connected to the motor. It will be understood by one of ordinary skill in the art that there are many different wireless technologies that may be utilized to allow for wireless controlling of the motor. It will also be understood by one of ordinary skill in the art that there are many different types of wireless controllers and sensors that can be used. Referring to FIG. 17, an exemplary embodiment of a wireless controller 830 is shown where the controller is integrated into a glove 835. The controller may have a dial 838 on it to direct movement of the training device. In other embodiments, however, the controller 830 may have buttons or other means for directing movement of the training device. While in FIG. 17 the controller 830 is integrated onto a glove 835, in other exemplary embodiments a wireless controller may be integrated or attached to any part of a player's body or clothing, including, but not limited to, a lacrosse stick, helmet, arm band, wrist band, or shoe.

Figure 18:
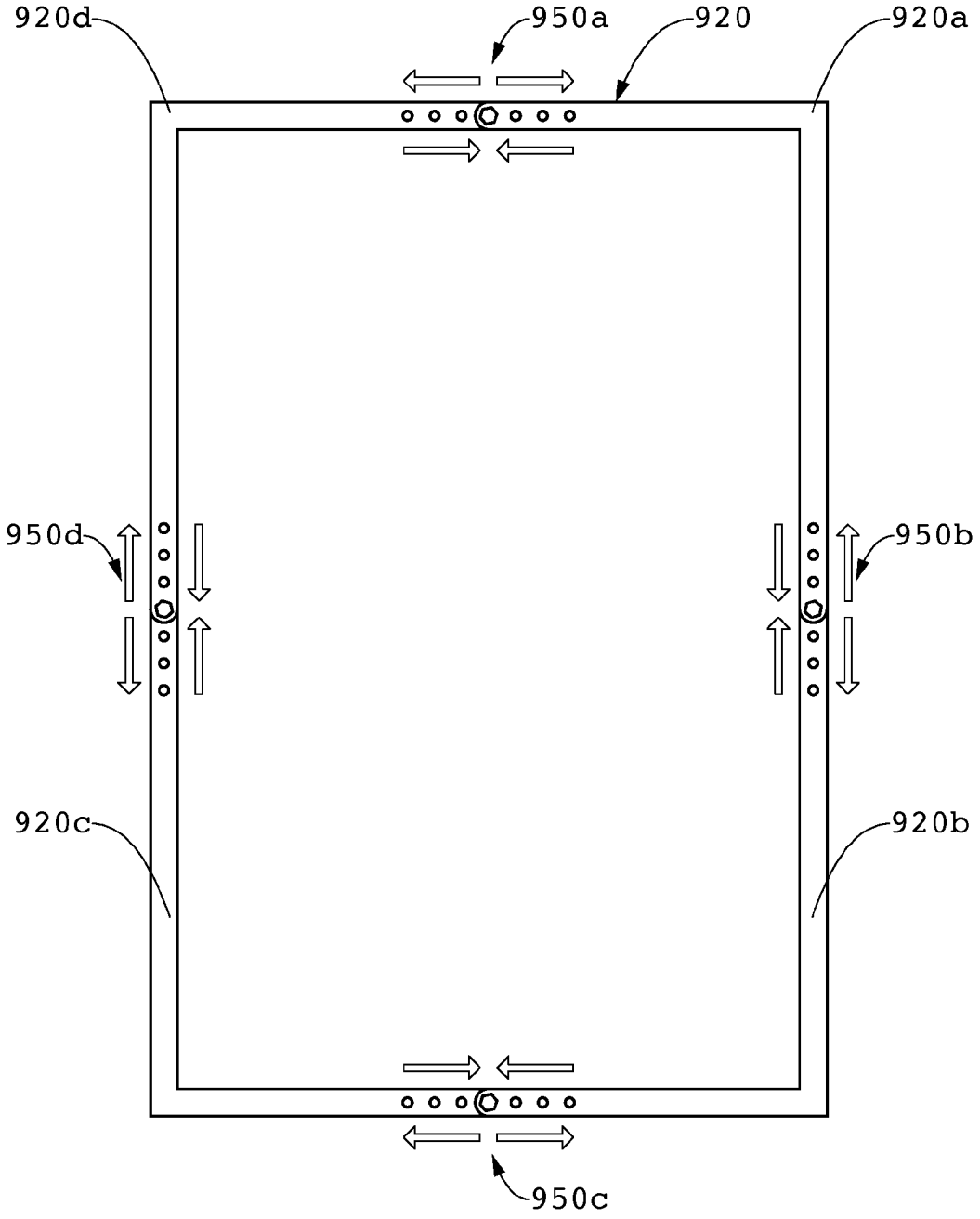
FIG. 18 is a front view of a ninth exemplary embodiment of a lacrosse training device.

Referring to FIG. 18, an exemplary embodiment of a modular frame 920 for a training device is shown. The frame 920 is comprised of four segments, 920*a*, 920*b*, 920*c*, and 920*d* that removably lock one to another through the use of biased spring loaded pins and holes located in the segments. Together, segments 920*a*, 920*b*, 920*c*, and 920*d* form the frame 920. Through the use of the biased spring loaded pins and holes, and the ability of the different segments to be collapsed into one another, the size of the frame 920 can be changed as desired. Directional arrows 950*a*, 950*b*, 950*c*, and 950*d* demonstrate how the different segments 920*a*, 920*b*, 920*c*, and 920*d* may be collapsed into and pulled out of one another in order to alter the size and dimensions of the frame 920. In other embodiments, different means for connecting the segments may be used, including, but not limited to, biased locking pins.

Figure 19:
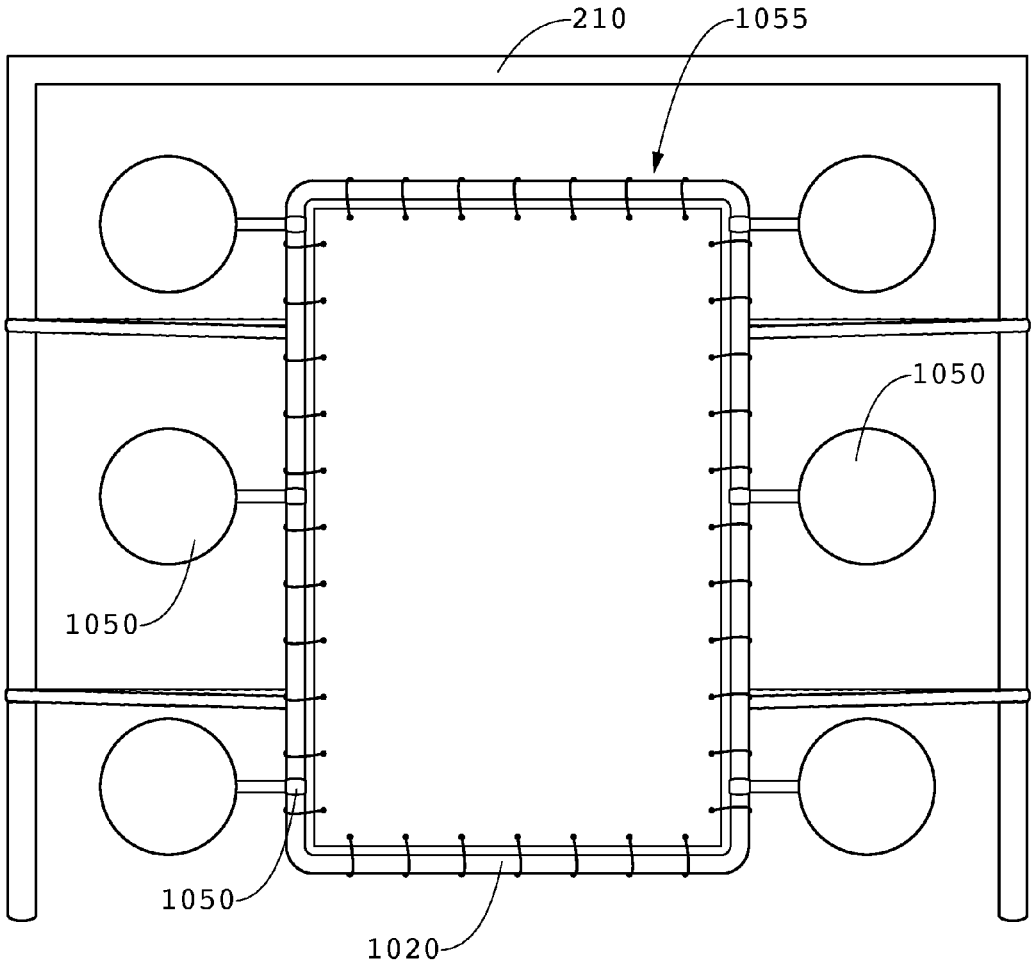
FIG. 19 is a front view of a tenth exemplary embodiment of a lacrosse training device.

Referring to FIG. 19, an exemplary embodiment of a training device 1010 is shown where the training device 1010 has six removable targets 1050. The removable targets 1050 are connected to the frame 1020 through spring loaded clamps 1055 that encircle the frame 1020. However, in other exemplary embodiments, the removable targets 1050 may be connected to the frame 1020 through the use of different removable attachments, including, but not limited to, Velcro™, snaps, and various clamps. Because they are removable, a player can adjust both the number and placement of the removable targets 1050 around the frame 1020 as desired. The removable targets 1050 may be made out of many different materials, including, but not limited to, plastic, wood, and metal. As shown in FIG. 19, the removable targets 1050 may be circular in shape, or they may have different shapes as desired. Their size may also vary depending on the needs of the player. In some embodiments the removable targets 1050 may be adapted to attach to both the frame 1020 and any support bars on the training device 1010. It will be understood by one of ordinary skill in the art that the removable targets 1050 can be shaped and modified in many different ways in order to provide targets for players wishing to practice their skills. In some exemplary embodiments the removable targets 1050 may not be removable at all, and may instead by permanently fixed to the sides of the training device 1010.

While certain embodiments of the present invention are described in detail above, the scope of the invention is not to be considered limited by such disclosure, and modifications are possible without departing from the spirit of the invention as evidenced by the claims. One skilled in the art would recognize that such modifications are possible without departing from the scope of the claimed invention.

What is claimed is:

1. A training device for placement in a goal, comprising:

a rectangular frame, having support bars affixed thereto;

a target material made from calendared trampoline fabric, said target material removably attached to said rectangular frame;

at least one strap having a first end and second end, said first end affixed to a first side of said goal passing between said rectangular frame and said support bars and said second end affixed to a second side of said goal;

at least one pair of external wheels attached to the bottom of said rectangular frame;

a track positioned beneath said wheels providing a surface for said wheels; and a motor affixed to said rectangular frame, said motor having a drive shaft in mechanical communication with said wheels, wherein said training device may be moved side-to-side within the goal.

2. The training device of claim 1, further comprising at least one retention member retaining said target material to said rectangular frame.

3. The training device of claim 2, wherein said retention member is a tension cord looped through said target material and said support bars.

4. The training device of claim 2, wherein said at least one retention member is a tie passing though said target material and removably affixed to said rectangular frame.

5. The training device of claim 1, wherein said rectangular frame is segmented into a first, a second, a third and a fourth segment, wherein said first, second, third, and fourth segment may slide into one another to adjust the dimension of the rectangular frame.

6. The training device of claim 1, further comprising at least one target removably attached to said rectangular frame.

7. The training device of claim 1, wherein said drive shaft is mechanically connected to said wheels by a chain.

8. The training device of claim 1, further comprising a controller for controlling said motor.

9. The training device of claim 1, wherein said target material slides over said rectangular frame.

10. A training device for placement in a goal, comprising:

a rectangular frame;

a target material made from calendared trampoline fabric, said target material removably attached to said rectangular frame;

external wheels attached to the bottom of said rectangular frame;

a motor attached to said rectangular frame, said motor having a drive shaft in mechanical communication with said wheels, said motor arranged to supply rotational motion to said wheels; and at least one strap supporting said rectangular frame and allowing said rectangular frame to move side-to-side within said goal when rotational motion is applied to said wheels.

11. The training device of claim 10, further comprising a controller to control said motor.

12. The training device of claim 11, wherein said controller is a wired controller attached to said rectangular frame.

13. The training device of claim 11, wherein said controller is a wireless controller.

14. The training device of claim 10, further comprising a track positioned beneath said wheels providing a smooth surface for said wheels to traverse.

15. The training device of claim 10, wherein said rectangular frame is segmented.

16. A training device for placement in a goal, comprising:

a segmented rectangular frame wherein said segments allow said frame to be dimensionally adjusted;

a target material removably attached to said rectangular frame, wherein said target material is calendared trampoline fabric;

external wheels attached to the bottom of said rectangular frame;

a motor attached to said rectangular frame, said motor having a drive shaft in mechanical communication with said wheels, said motor arranged to supply rotational motion to said wheels;

at least one strap supporting said rectangular frame and allowing said rectangular frame to move side-to-side within said goal when rotational motion is applied to said wheels; and a controller for directing said motor to supply directional motion to said wheels.

17. The training device of claim 16, further comprising a track positioned beneath said wheels providing a smooth surface for said wheels to traverse.

18. The training device of claim 16, wherein said controller is wireless.

* * * * *